US005749046A

United States Patent [19]

Ohta et al.

[11] Patent Number: 5,749,046

[45] Date of Patent: May 5, 1998

[54] SIGNAL LEVEL MEASURING APPARATUS FOR DIRECTING AN ANTENNA TOWARD A SATELLITE

[75] Inventors: Minoru Ohta; Akihiro Fujimoto, both of akashi, Japan

[73] Assignee: DX Antenna Company, Limited, Kobe, Japan

[21] Appl. No.: 485,687

[22] Filed: Jun. 7, 1995

[30] Foreign Application Priority Data

Jul. 5, 1994 [JP] Japan ..... 6-177649

[51] Int. Cl.[6] ..... H01Q 3/00

[52] U.S. Cl. ..... 455/67.1; 455/348; 455/90; 455/289

[58] Field of Search ..... 455/3, 2, 347–349, 455/67.1, 67.3, 131, 226.2, 226.4, 67.7, 289, 89, 90, 117; 343/703, 760, 820; 361/736, 753, 799, 800, 816, 818, 728, 752, 807, 809; 174/35 R, 35 GC, 35 TS, 51; 324/76.14, 133; D10/78; 379/21; 333/116, 238, 128, 112

[56] References Cited

U.S. PATENT DOCUMENTS

| | | | |
|---|---|---|---|
| D. 365,031 | 12/1995 | Kim | D10/78 |
| 4,186,283 | 1/1980 | Simmonds | 379/21 |
| 4,729,129 | 3/1988 | Koerner | 455/117 |
| 4,736,170 | 4/1988 | Wu et al. | 332/21 |
| 5,020,134 | 5/1991 | Pecaut | 455/67.7 |
| 5,126,704 | 6/1992 | Dittmer et al. | 333/128 |
| 5,150,282 | 9/1992 | Tomura et al. | 174/35 R |
| 5,198,787 | 3/1993 | Sano et al. | 333/128 |
| 5,251,329 | 10/1993 | Takagi et al. | 455/90 |
| 5,386,587 | 1/1995 | Yuzawa | 455/3.2 |
| 5,398,169 | 3/1995 | Gorenz, Jr. et al. | 174/35 R |
| 5,422,681 | 6/1995 | Hayashi | 455/3.2 |
| 5,519,405 | 5/1996 | Matsubara et al. | 343/757 |

FOREIGN PATENT DOCUMENTS 6052706 4/1985 Japan .

*Primary Examiner*—Reinhard J. Eisenzopf
*Assistant Examiner*—Lester G. Kincaid
*Attorney, Agent, or Firm*—Duane, Morris & Heckscher LLP

[57] ABSTRACT

A signal level measuring apparatus measures a level of a satellite signal from a geostationary satellite as received by a receiving antenna and provides an output to determine whether the antenna is correctly directed to the satellite. The apparatus is disposed between a converter associated with the antenna for converting the satellite signal into an IF signal and a tuner for demodulating the IF signal. The apparatus distributes and divides the IF signal from an input terminal of the apparatus into two output signals. One of the output signals is coupled to an output terminal of the apparatus, which, in turn, is coupled to the tuner. The other output signal is applied to level detector. An output from the level detector is compared with a reference signal. Depending on the comparison output, the state of light emission of a light-emitting device varies.

4 Claims, 8 Drawing Sheets

SIGNAL LEVEL MEASURING APPARATUS FOR DIRECTING AN ANTENNA TOWARD A SATELLITE

This invention relates to an apparatus for measuring a signal receiving level at an antenna and, in particular, to such an apparatus for measuring a level of a signal from a geostationary satellite, such as a broadcasting satellite and a communications satellite, received at a receiving antenna while it is being directed to a direction from which the signal is coming. (Hereinafter, such signal is referred to as "satellite signal".)

BACKGROUND OF THE INVENTION

One of conventional received signal level measuring apparatus is shown in, for example, Japanese Unexamined UM Publication No. SHO 60-52706. A converter is attached to a satellite signal receiving antenna, and the converter converts a satellite signal in, for example, a 11 GHz band received by the receiving antenna to an intermediate frequency (IF) signal in, for example, a 1 GHz band.

The IF signal is applied to an input of a directional coupler within the measuring apparatus. The IF signal applied to the directional coupler is coupled at the output of the coupler to a tuner external to the measuring apparatus, where it is demodulated and applied to a television receiver. Another part of the IF signal branched from the directional coupler is amplified to a desired level in an amplifier within the measuring apparatus, detected by a detector, then, amplified by a DC amplifier, and is applied to an indicator. The azimuth and elevational angles of the receiving antenna are adjusted so that a maximum level is indicated on the indicator. The DC amplifier is provided with a sensitivity adjuster for adjusting the gain of the DC amplifier so as to enable the adjustment of the sensitivity on the indicator.

This type of signal level measuring apparatus has a disadvantage that the level of the IF signal for detection is low because the IF signal is a branched version from the directional coupler. As described above, the branched version of the IF signal is then amplified by the amplifier before it is detected in the detector. Therefore, distortion or noise may have been introduced into the IF signal in the amplifier when it is applied to the detector. In such a case, the correct signal level of the IF signal cannot be indicated. In addition, the use of such amplifier disadvantageously increases the cost of the apparatus.

This measuring apparatus is usually provided with an impedance matching circuit at each of the input, output, and branch sides of the directional coupler. The provision of three matching circuits makes the manufacture of the apparatus troublesome and expensive.

In the signal level measuring apparatus, the IF signal inputted to the apparatus is an ultra-high frequency signal in the 1 GHz band, and, therefore, it is necessary to completely shield the measuring apparatus in order to prevent ultra-high frequency signals from being radiated from the apparatus.

The signal level measuring apparatus is preferably positioned near a receiving antenna so that an operator who adjusts the elevation and azimuth angles of the antenna can directly read an indication on the indicator to facilitate the adjustment of the antenna direction. Accordingly, it is desirable that the measuring apparatus be small in size and be capable of holding by hand.

Therefore, an object of the present invention is to provide a signal level measuring apparatus that can provide precise indication of a level of an intermediate frequency signal and still is manufactured at a reduced cost.

Another object of the present invention is to provide a signal level measuring apparatus having a reduced number of impedance matching circuits used therein, so that the manufacture of the apparatus can be simplified and the manufacturing cost can be reduced.

Still another object of the present invention is to provide a signal level measuring apparatus which radiates no ultra-high frequency signals.

A further object of the present invention is to provide a signal level measuring apparatus that can be held by hand and hardly slips off the hand.

Other objects of the present invention will be understood from the detailed description of embodiments which is made later.

SUMMARY OF THE INVENTION

A signal level measuring apparatus according to the present invention measures the level of a signal received by a receiving antenna which receives a satellite signal transmitted from a geostationary satellite, and the measured signal level is used in adjusting the direction of the receiving antenna so as to direct it toward the geostationary satellite. The signal level measuring apparatus is interposed between a converter associated with the receiving antenna for converting the received satellite signal to an intermediate frequency (IF) signal, and a tuner for demodulating the IF signal. The signal level measuring apparatus includes an input terminal to which the IF signal is applied, distributing means which receives the IF signal from the input terminal and distributes the IF signal between two outputs, an output terminal to which one of the two distribution outputs is developed for coupling to the tuner, level detecting means to which the other of the two distribution outputs is directly coupled and which detects the level of the other distribution output, comparing means which compares the output of the level detecting means with a reference signal, and a light-emitting device which emits light variable in accordance with the result of the comparison in the comparing means.

The distributing means may include a first microstrip line having one end thereof connected to the output terminal of the measuring apparatus, and a second microstrip line having one end thereof connected to the level detecting means. The first and second microstrip lines may have a length related to a wavelength of the IF signal and have their other ends connected together to a first input terminal. An impedance matching capacitor may be connected between the interconnected ends of the first and second microstrip lines and a point of reference potential.

The capacitance of the impedance matching capacitor may be selected such that the VSWR at the input and distribution output sides of the distributing means is 2.5 or less.

The distributing means, the level detecting means, and the comparing means may be disposed on a first one of opposing major surfaces of a printed circuit board. A substantial portion of a second one of the opposing major surfaces of the printed circuit board is at a reference potential. The printed circuit board is placed in a shield casing having an opening in one side, with the first surface facing outward and closing the opening in the shield casing. The shield casing may be disposed in an insulating housing, together with the input terminal, the output terminal, and the light-emitting device.

The comparing means may be arranged to compare an output signal of the level detecting means with a reference signal, and the light-emitting device may be energized to emit light when the output signal of the level detecting means is less than the reference signal. Means for adjusting the value of the reference signal may be used.

The comparing means may be operated with power supplied from the tuner to the output terminal, and the supplied power may be fed from the input terminal to the converter.

According to another aspect of the present invention, a signal level measuring apparatus is provided, which measures the level of a signal received by a receiving antenna which receives a satellite signal transmitted from a geostationary satellite, and the measured signal level is used in adjusting the direction of the receiving antenna so as to direct it toward the geostationary satellite. The signal level measuring apparatus is interposed between a converter associated with the receiving antenna for converting the received satellite signal to an intermediate frequency (IF) signal, and a tuner for demodulating the IF signal. The signal level measuring apparatus includes an input terminal to which the IF signal is applied, level measuring means for measuring the level of the IF signal from the input terminal, indicating means for indicating the result of measurements made in the level measuring means, and an output terminal from which the IF signal is coupled to the tuner. The input terminal, the level measuring means, the indicating means, and the output terminal are placed in a housing. The housing has a shape of a modified column with a flat surface formed on its outer surface which extends in the length direction of the column to prevent the housing from rolling. The housing further includes undulations which undulate in the length direction in the flat surface.

The housing may comprise first and second halves which result from longitudinally halving the housing. Each of the first and second halves has two longitudinally extending edges, and the two halves are hinged. The edge of the first half opposite to the hinged edge is provided with a finger with an outward protruding claw at its distal end, while the edge of the second half opposite to its hinged edge is provided with a recess or jaw with which the claw of the first half can engage when the first and second halves are closed.

The level measuring means may be disposed on a first one of opposing major surfaces of a printed circuit board. A substantial portion of a second one of the major surfaces of the printed circuit board is at a reference potential. The printed circuit board is mounted in a shield casing with an opening in one side thereof in such a manner that the second major surface of the printed circuit board is facing outward. The indicating means is also disposed on the second major surface of the printed circuit board. The shield casing is disposed in the housing.

Projections may be formed on the inner surface of the shield casing for supporting the printed circuit board.

DETAILED DESCRIPTION OF PREFERRED EMBODIMENT

Figure 1:
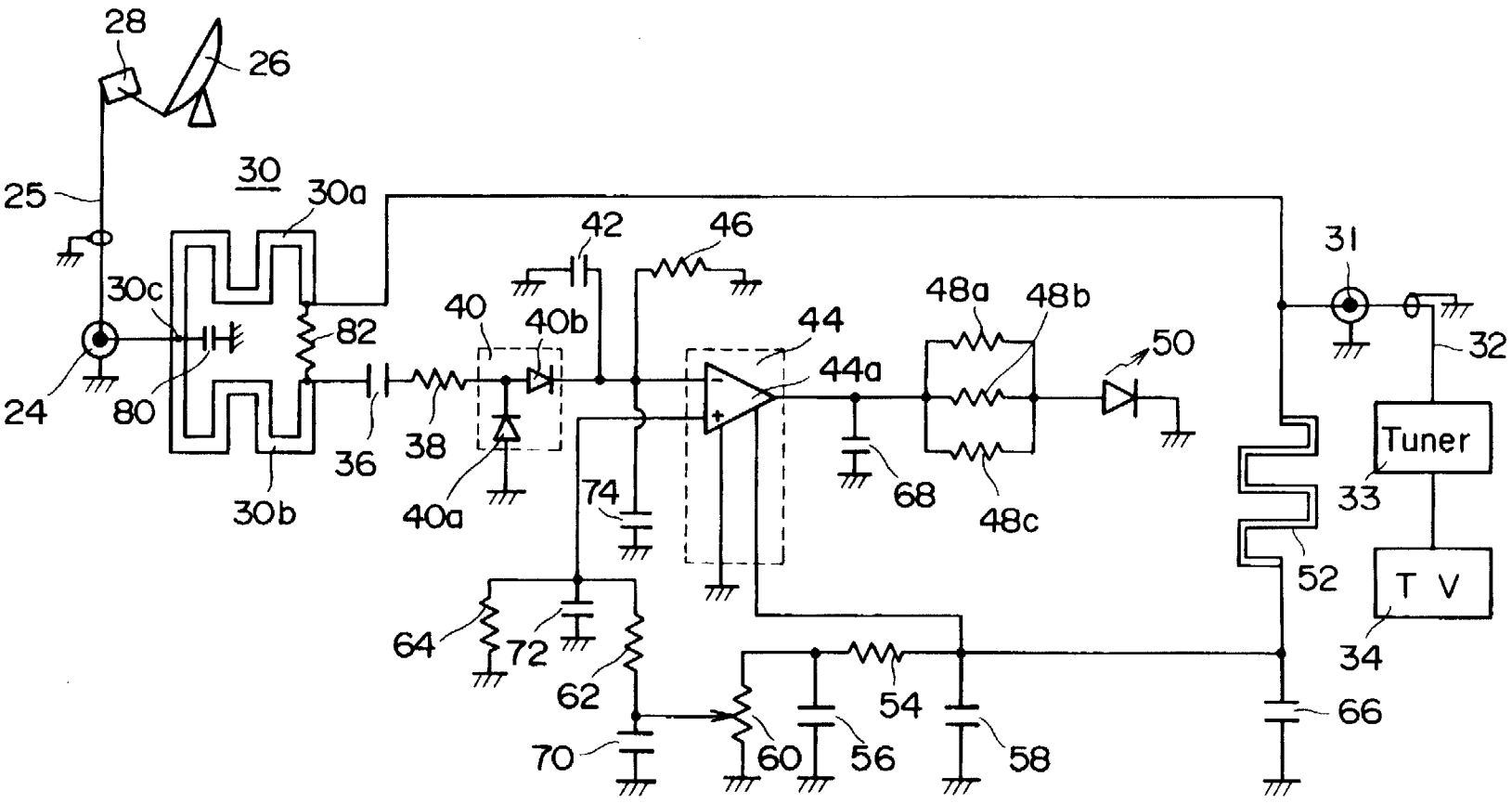
FIG. 1 is a circuit diagram of a signal level measuring apparatus according to one embodiment of the present invention.

As shown in FIG. 1, a receiving antenna input signal level measuring apparatus according to one embodiment of the present invention includes an input terminal 24. The input terminal receives an intermediate frequency (IF) signal supplied from a converter 28 provided in association with a receiving antenna, such as a parabola antenna 26, through a coaxial cable 25. The receiving antenna 26 receives a broadcast signal from a geostationary satellite in, for example, a 11 GHz band, and the converter 28 frequency-converts the received satellite broadcast signal to an IF signal in, for example, a 1 GHz band.

The input terminal 24 is connected to the input of a distributor 30 which distributes a signal input to two outputs. The IF signal output distributed to one output terminal 31 is coupled to, for example, a satellite broadcast signal receiver tuner 33 through a coaxial cable 32, and it is demodulated in the tuner 33 and applied to a television receiver 34.

The other distributor output is coupled through a DC blocking capacitor 36 and a resistor 38 to a level detector 40 including diodes 40*a* and 40*b*, and its level is determined in the level detector 40.

The output of the level detector 40 is smoothed by a smoothing capacitor 42 before it is applied to an inverting input terminal of a comparator 44*a* disposed in an IC 44. A resistor 46 is connected between the inverting input terminal of the comparator 44*a* and ground, and a voltage proportional to the output of the level detector 44 is developed across the resistor 46. As will be described later, a reference voltage is applied to the non-inverting input terminal of the comparator 44*a*. The comparator 44*a* develops an output signal at a high (H) level when the voltage at the inverting input terminal (i.e. the voltage proportional to the output of the level detector 40) is smaller than the reference voltage, and an output signal at a low (L) level when the voltage at the inverting input terminal is larger than the reference voltage.

The output signal of the comparator 44*a* is coupled through a parallel combination of current limiting resistors 48*a*, 48*b*, and 48*c*, to a light-emitting device. For example, the comparator output signal may be coupled to an anode electrode of a light-emitting diode (LED) 50, which has its cathode electrode grounded. Thus, the LED 50 emits light when the voltage at the inverting input terminal of the comparator 44*a* is smaller than the reference voltage, and when the voltage at the inverting input terminal of the comparator 44*a* becomes larger than the reference voltage, it stops emitting light.

The tuner 33 supplies a DC voltage for operating the converter 28 and the comparator 44*a* and for providing the reference voltage through the coaxial cable 32 to the output terminal 31. The DC voltage supplied at the output terminal 31 is supplied through the distributor 30 to the input terminal 24, from which it is coupled through the coaxial cable 25 to the converter 28. Thus, the distributor 30 is of the type which couples a DC supply directly to the input terminal 24.

The DC voltage supplied to the output terminal 31 is coupled through an ultra-high frequency blocking coil 52 to a power supply terminal of the IC 44. This DC voltage, after being smoothed by a smoother circuit including a resistor 54 and capacitors 56 and 58, is coupled to one end of a variable resistor 60 having its other end grounded. A DC voltage derived through an arm on the variable resistor 60 is further voltage-divided by resistors 62 and 64, and the voltage developed at the junction of the resistors 62 and 64 is applied to the non-inverting input terminal of the comparator 44*a* as the reference voltage. Varying the position of the arm on the variable resistor 60, the value of the reference voltage can be changed to thereby adjust the sensitivity of the signal level measuring apparatus.

Bypass capacitors 66, 68, 70, 72, and 74 are connected at appropriate positions as shown.

The illustrated signal level measuring apparatus does not employ a directional coupler, but employs the distributor 30 which distributes a signal to two paths. With this arrangement, the insertion loss is smaller than in the case where a branching device or a directional coupler is used, so that a higher level IF signal can be derived at the respective distributor outputs. Accordingly, the distributor output need not be amplified before it is supplied to the level detector 40, which enables the level detection free of influence by signal distortion or noise. Furthermore, since the measuring apparatus and the converter 28 can be operated from the power supply for the tuner 33, no extra power supply for operating the level measuring apparatus need be disposed within the level measuring apparatus, which enables reduction of manufacturing cost and the size of the apparatus.

Figure 2A:
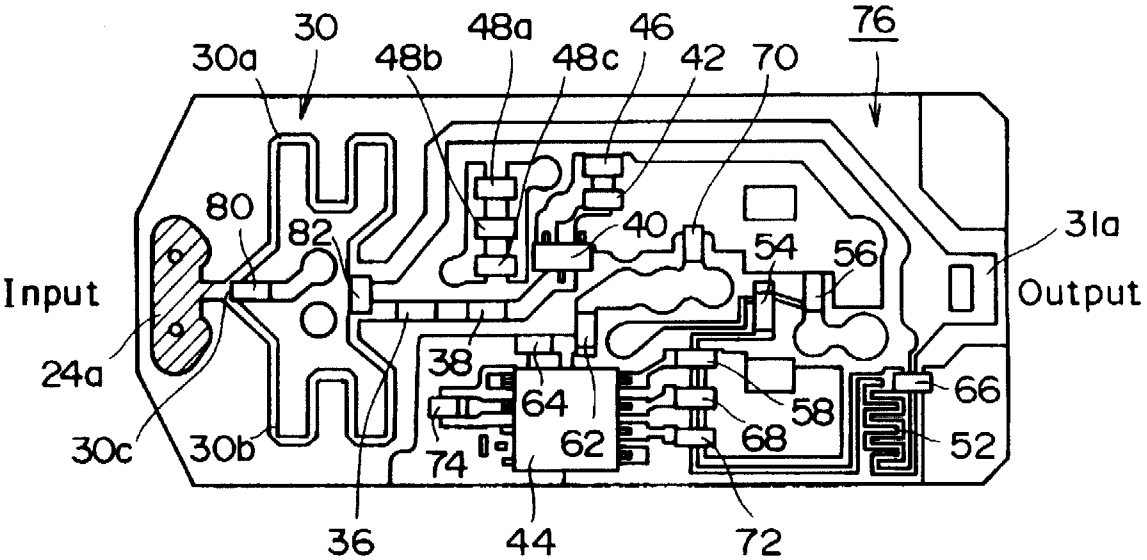
FIG. 2*a* shows a first major surface of a printed circuit board on which the circuit of FIG. 1 is formed.
Figure 2B:
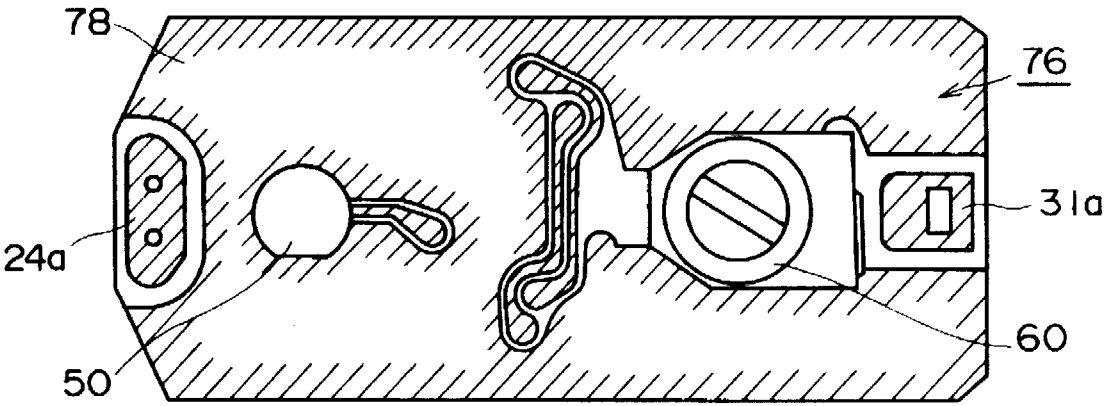
FIG. 2*b* shows a second opposite major surface of the printed circuit board of FIG. 2*a;*

As shown in FIGS. 2*a* and 2*b*, the entire, except the input terminal 24 and the output terminal 31, of the signal level measuring apparatus is formed on a printed circuit board 76. The connections of the portion on the printed circuit board 76 to the input terminal 24 and to the output terminal 31 are provided via an input terminal connector section 24*a* and an output terminal connector section 31*a*, respectively.

As shown in FIG. 2*b*, most of the area of one of two major surfaces of the printed circuit board 76 is formed as a reference potential plane 78, and the LED 50 and the variable resistor 60 are disposed on the first, major surface at locations outside the reference potential plane. The remaining electronic components are disposed on the other, second major surface, as shown in FIG. 2*a*. The board for the printed circuit board 76 has a thickness of, for example, 1.2 mm and a relative dielectric constant of about 4.7.

The distributor 30 comprises a crank-pattern of microstrip lines 30*a* and 30*b* on the second major surface, as shown. The crank pattern of the microstrip lines 30*a* and 30*b* can reduce the size of the distributor. In principle, the length of the microstrip lines 30*a* and 30*b* is $\lambda/4$, where $\lambda$ is the propagation wavelength at the center frequency of the IF signal applied to the input terminal 24. For example, the microstrip lines 30*a*, 30*b* have a width of 0.5 mm, and the length of 32.5 mm. These values are calculated on the assumption that the effective relative dielectric constant of the printed circuit board is about 3.7 and the wavelength reduction ratio attributable to the effective relative dielectric constant of the board is about 0.52. One end of each respective microstrip lines 30*a* and 30*b* are connected together at a node 30*c* which is, then, coupled via the input terminal connector section 24*a* to the input terminal 24.

The impedances at the input of the distributor 30 and at the two outputs of the distributor are chosen to be 75Ω, but the impedance at the output of the distributor 30 that is connected to the level detector 40 is subject to variations due to influences given by the level detector 40, the comparator 44*a* etc. and also due to variations in input power fed in the input side. Also, due to a large area of the input terminal connector section 24*a* required for soldering it to the contact at the center of the input terminal 24, and variations in amount of solder, the capacitance in the input side of the distributor 30 varies. In order for such variations in impedance to be absorbed, a matching circuit is usually used to compensate capacitance and inductance components. A measuring apparatus of this type, however, is practically useable if its voltage standing wave ratio (VSWR) is 2.5 or less, and, therefore, in the illustrated embodiment, too, required impedance matching is provided by disposing a capacitor 80 between the junction 30*c* and a point of reference potential. The value of the capacitor 80 required for providing a practical VSWR is within a range of from 0.5 pF to 2 pF, and the value in the illustrated embodiment is 1 pF. An isolation resistor 82 is connected between the respective opposite ends of the microstrip lines 30*a* and 30*b*. The value of the resistor 82 is, for example, 150Ω.

Figure 3:
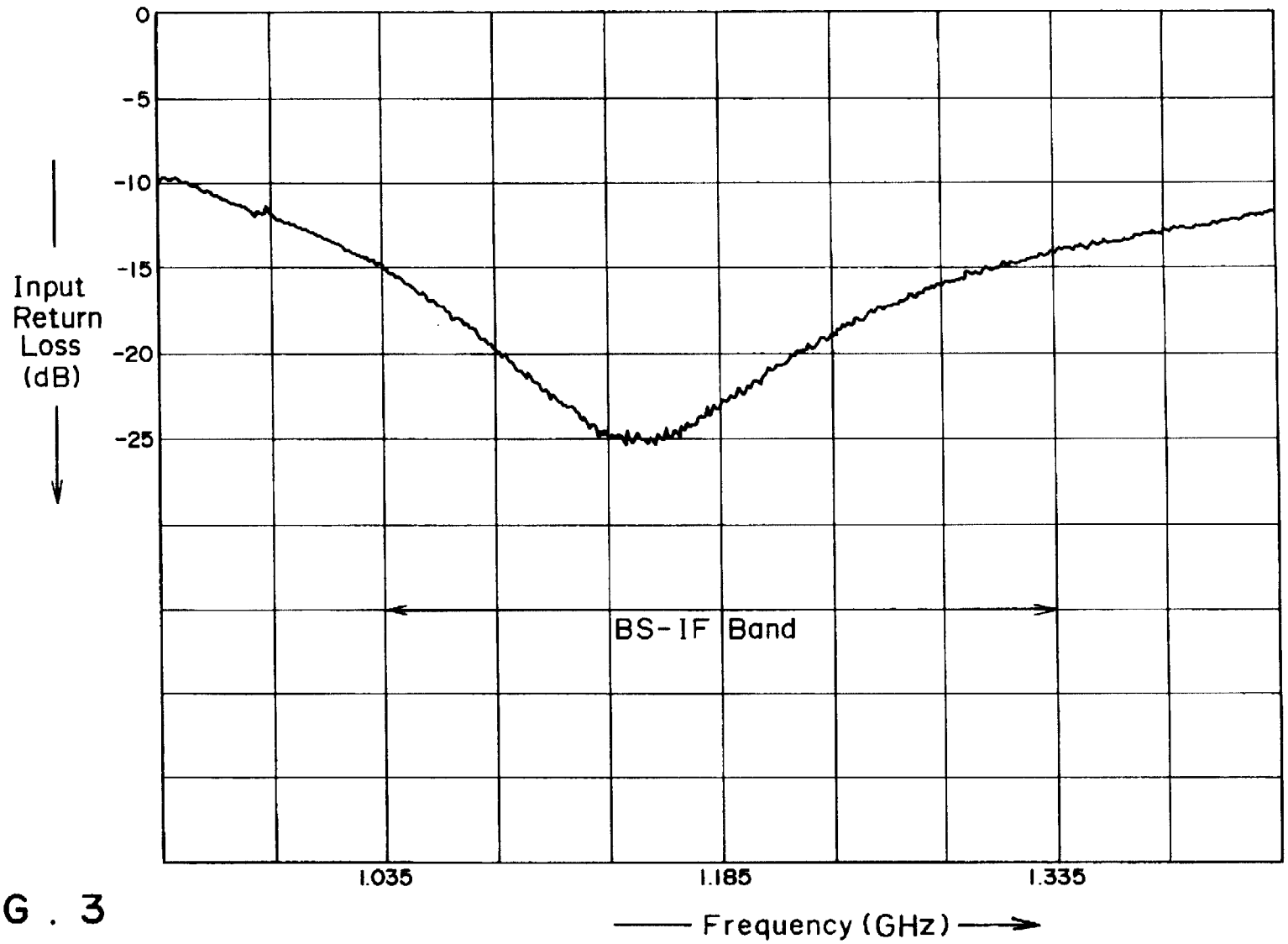
FIG. 3 is an input return-loss-versus-frequency characteristic of the circuit of FIG. 1.

FIG. 3 shows input return loss of the distributor 30. The minimum input return loss in the frequency band of the IF signal supplied from the converter 28 to the distributor 30 is about 15 dB, and the maximum input return loss is about 25 dB. Then, the input VSWR is 1.5 or less.

Figure 4:
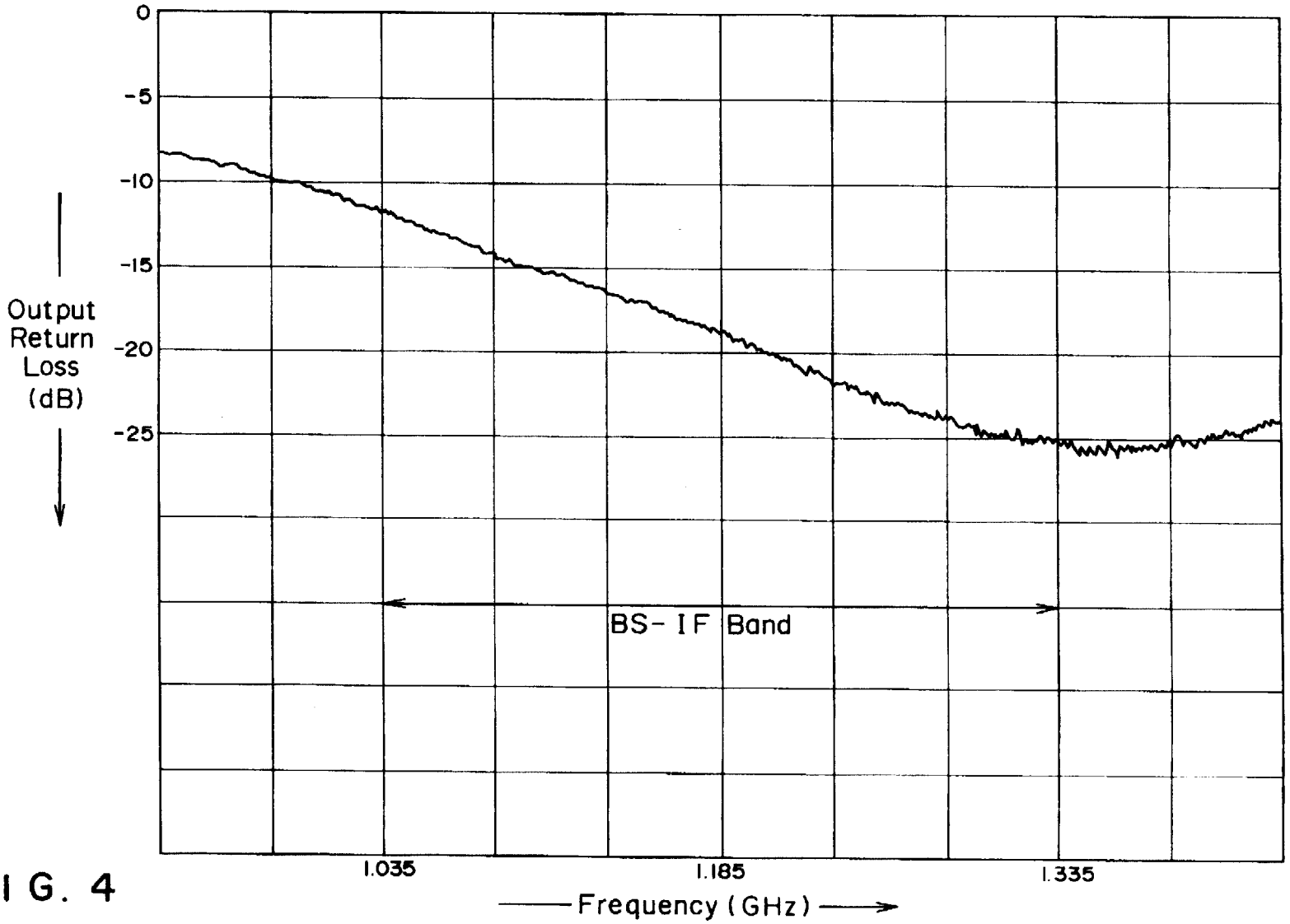
FIG. 4 is an output return-loss-versus-frequency characteristic of the circuit of FIG. 1.

FIG. 4 shows output return loss of the distributor 30. The minimum and maximum output return losses in the IF signal frequency band are about 12 dB and about 26 dB, respectively. This provides an output VSWR of 1.7 or less. A desirable VSWR for equipment for transmission of IF signals of satellite broadcast systems is 1.8 or less. Thus, the distributor 30 is provided with impedance matching between its input and its outputs. Accordingly, there is no need to connect a matching device either in the input side or two output sides of the distributor 30. This simplifies the manufacturing process and reduces the cost.

Figure 5:
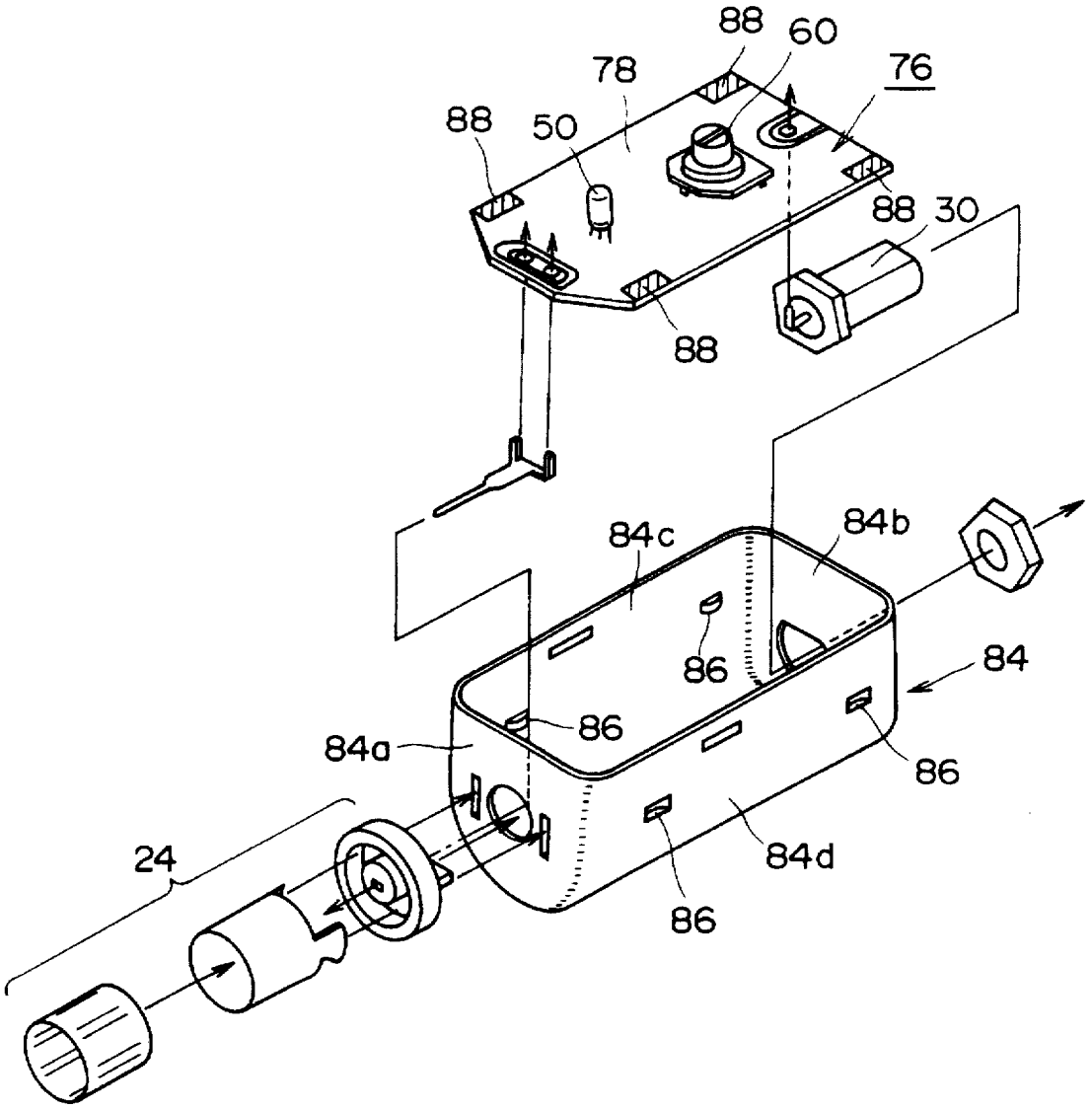
FIG. 5 is an exploded view showing how to mount the printed circuit board of FIG. 2 into a shield casing.

The circuits formed on the board 76 is placed in a shield casing 84 of electrically conducting metal, as shown in FIG. 5. The shield casing 84 is box-shaped and includes opposing end walls 84*a* and 84*b*, and opposing side walls 84*c* and 84*d*. The casing 84 is open in its top side. The input terminal 24 is mounted on the end wall 84*a*, and the output terminal 30 is attached to the end wall 84*b*. Four projections 86 protrude inward from the respective side walls 84*c* and 84*d*, two from each side wall. The projections 86 support the printed circuit board 76.

The printed circuit board 76 is put in the casing 84 through the open top side, with the reference potential plane 78 of the board 76 facing upward or outward and with the surface of the board 76 facing downward or inward of the casing 84. The printed circuit board 76 rests on the four projections 86. At least four corner portions 88 of the reference potential plane 78 of the board 76 are soldered to the shield casing 84. Also, the input terminal 24 and the output terminal 30 are soldered to the input terminal connector section 24*a* and the output terminal connector section 30*a*, respectively.

With this arrangement, even before the open side of the shield casing 84 is not closed by a conductive metal lid, substantial shielding effect can be provided, since the printed circuit board 76 is fitted into the casing 84 through the open side and, in addition, the surface of which a substantial portion (78) is at a reference potential facing outward and is soldered to the shield casing 84. Furthermore, since those components which are exposed on the reference potential plane side 78 of the board 76 are ones which process not high frequency signals but DC signals, they do not give any influences in terms of high frequency and, therefore, have nothing to do with the shielding effect of the shield casing 84.

Figure 6:
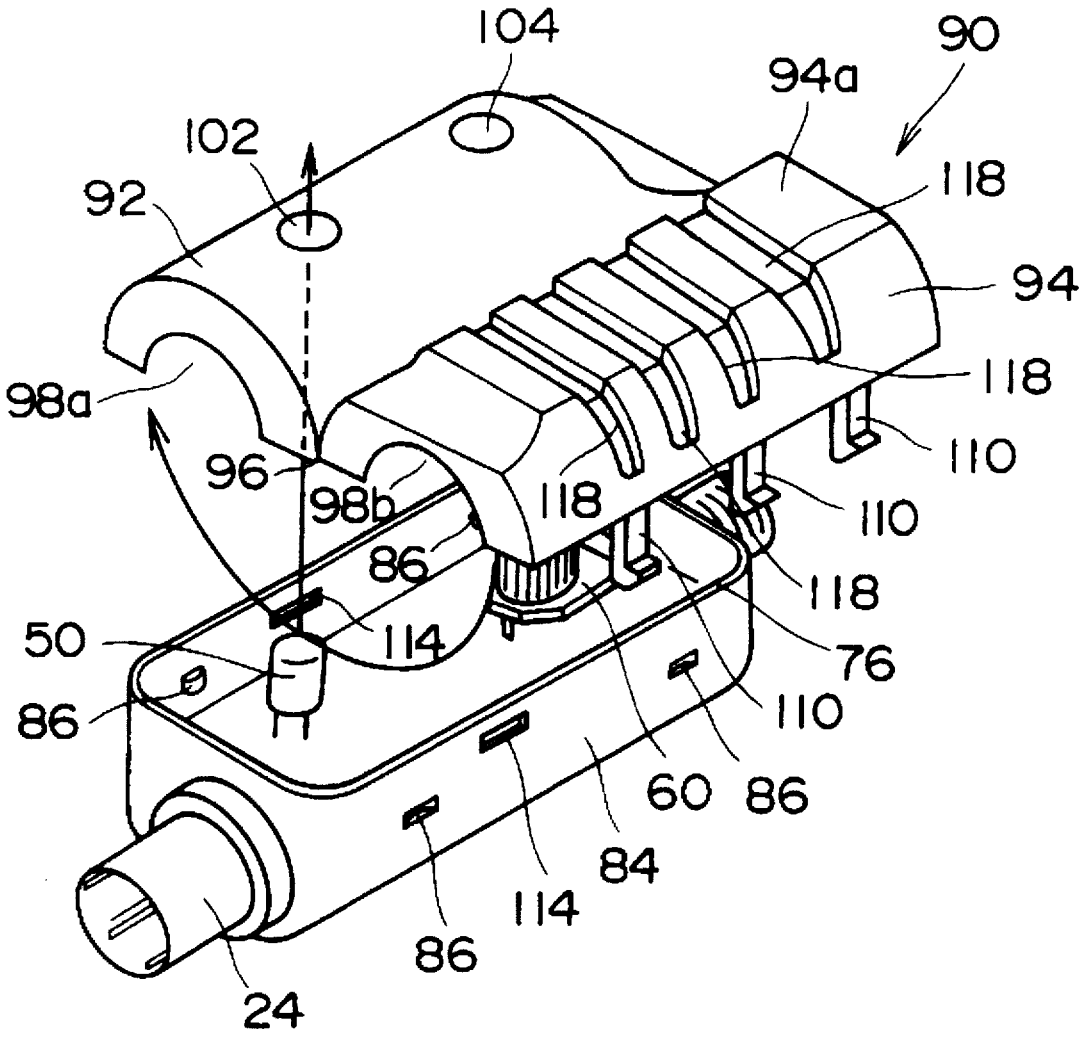
FIG. 6 shows how to mount the shield casing of FIG. 5 in an outermost housing.
Figure 7:
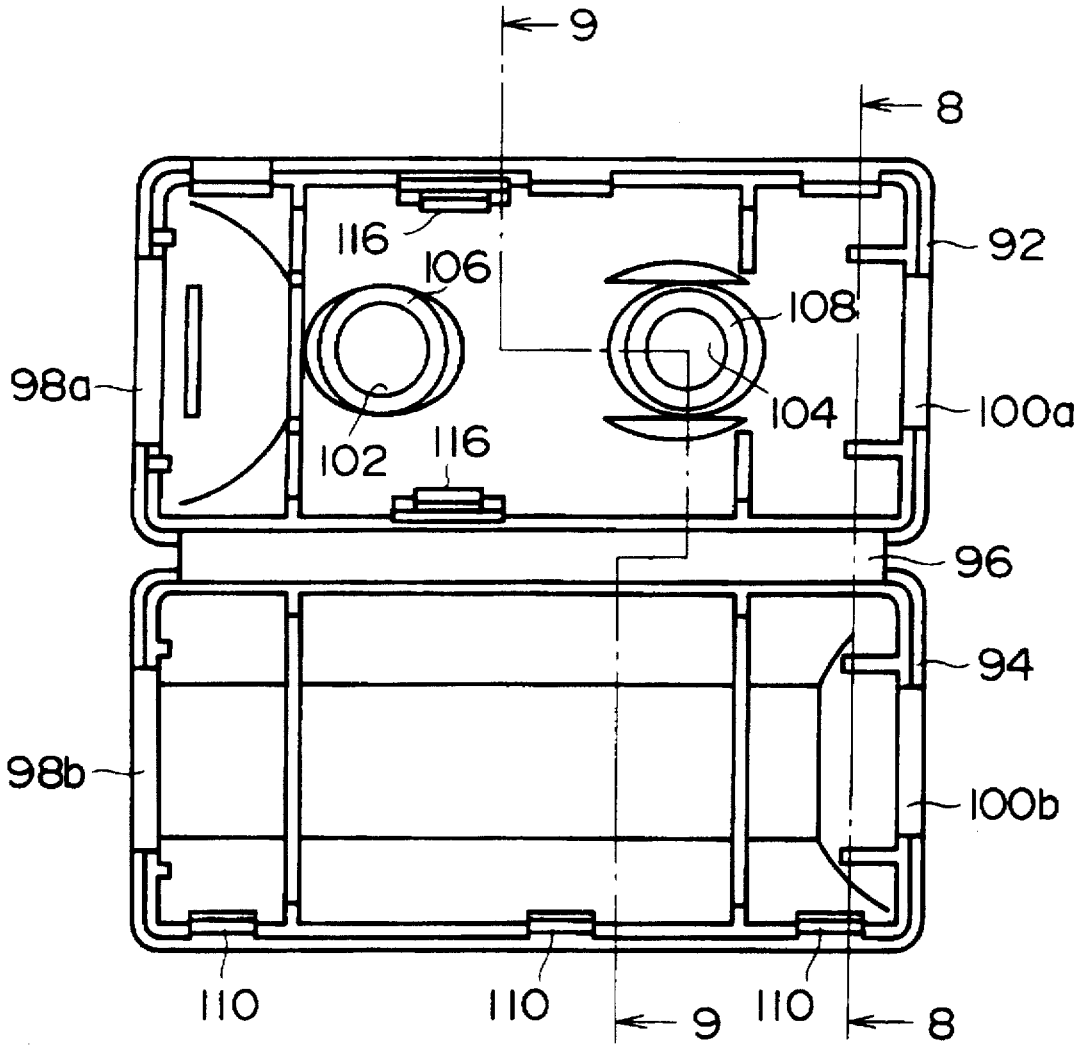
FIG. 7 shows the opened outermost housing of FIG. 6.

The shield casing 84 is then placed within an outer housing 90 of insulating material, such as plastic material, as shown in FIG. 6. The outer housing 90 has a generally columnar shape, and a portion is cut away along its length direction. The housing 90 is divided along its length direction into two longitudinal halves 92 and 94 which are hinged at a longitudinally extending portion 96. As shown in FIG. 7, too, opening halves 98*a* and 98*b* are formed in the corresponding one end walls of the housing halves 92 and 94. When the housing halves 92 and 94 are mated to form the housing 90, the opening halves 98*a* and 98*b* form an opening through which the input terminal 24 extends outward. Similar opening 100*a* and 100*b* are formed in the respective other end walls of the housing halves 92 and 94. When the housing halves 92 and 94 are mated to form the housing 90, the opening halves 100*a* and 100*b* form an opening through which the input terminal 30 extends outward.

The shield casing 84 is placed within the outer housing 90 in such a manner that the upper half portion of the shield casing 84 is positioned in the housing half 92, while the lower portion of the shield casing 84 is positioned in the half 94.

A hole 102 is formed to extend through the housing half 92, through which whether the LED 50 is emitting light or not can be seen, also, another hole 104 extends through the housing half 92 through which an operator can make adjustment of the variable resistor 60. As shown in FIG. 7, sleeves 106 and 108 extend inward of the housing half 92, which communicate with the respective holes 102 and 104. The LED 50 and the variable resistor 60 are placed within the sleeves 106 and 108 so that the sleeves 106 and 108 provide protection for the LED 50 and the variable resistor 60.

As shown in FIGS. 6–9, in order to join the halves 92 and 94 together to form the housing 90 with the shield casing 84 housed therein, three fingers 110 with claws at the respective distal ends thereof are formed to extend in the tangential direction from the longitudinal edge of the housing half 94 opposite to the longitudinal edge provided with the hinge 96. The fingers 110 are spaced along the length of the edge. The claws face and protrude outward from the distal ends of the respective fingers 110.

Figure 8:
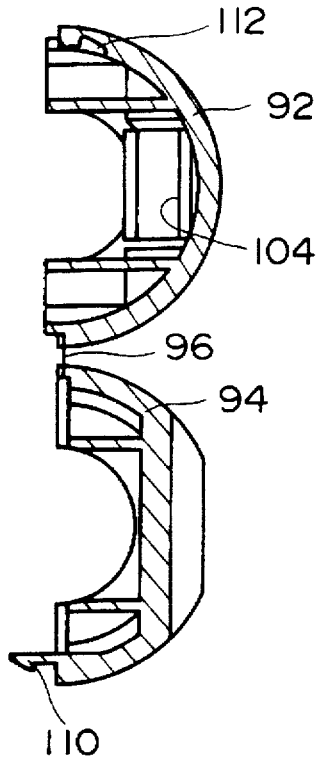
FIG. 8 is a cross-sectional view along the line 8—8 in FIG. 7.
Figure 9:
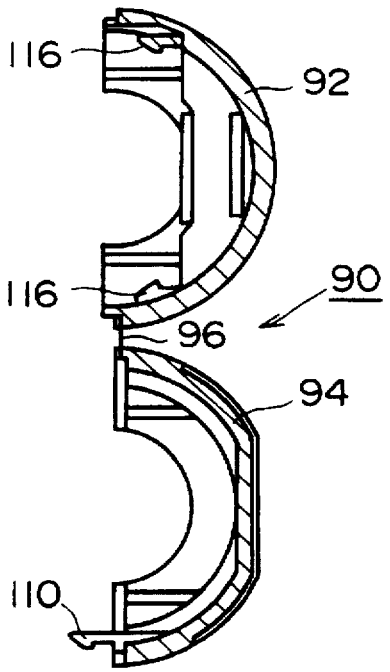
FIG. 9 is a cross-sectional view along the line 9—9 in FIG. 7.

As is seen from FIG. 8, recesses 112 are formed in the wall of the housing half 92 at locations slightly inward of the edge opposite to the edge provided with the hinge 96. The locations of the recesses 112 along the length direction of the edge correspond to the locations of the fingers 110 on the mating edge of the housing half 94. The fingers 110 and the recesses 112 are arranged such that when the housing halves 92 and 94 are closed, the claws on the fingers 110 snap into the associated recesses 112.

Thus, as shown in FIG. 6, after placing the shield casing 84 within the upper housing half 92, the lower half 94 is turned about the hinge 96 in the direction indicated by an arrow. This causes the claws of the fingers 110 snap into the respective recesses 112 so that two housing halves 92 and 94 are coupled to each other along the mating edges to thereby form the housing. In this state, the fingers 110 (and, therefore, the claws) and the recesses 112 do not appear at the outside of the housing 90, and, therefore, inadvertent opening of the housing is avoided.

The housing 90 formed by the halves 92 and 94 closed is generally columnar shaped and includes a flat surface 94*a*, as previously stated.

In order to prevent the shield casing 84 from being removed from the housing half 92 when the casing 84 is housed in the housing 90 so as to facilitate the assemblage of the apparatus, a slot 114 is formed in each of the side walls of the shield casing 84 as shown in FIG. 6, and corresponding claws 116 (FIGS. 7 and 9) are formed at corresponding locations on the inner surface of the housing half 92 so that the respective claws 116 engage with the corresponding slots 114 to thereby fix the shield casing 84 within the housing half 92 when the upper portion of the shield casing 84 is placed within the half portion 92.

As shown in FIG. 6, a plurality, four in the illustrated embodiment, of grooves 118 extending transverse to the flat surface 94*a* of the housing half 94 are spaced in the length direction of the surface 94*a*. The flat surface 94*a* and the grooves 118 which make the flat surface 94*a* have irregularities therein efficiently prevent the apparatus from slipping off from a hand of an operator.

In use, the signal level measuring apparatus described is placed near the receiving antenna 26. Let it be assumed that the antenna 26 is not correctly directed to the satellite (not shown). The input terminal 24 of the apparatus is connected to the output of the converter 28 by means of the coaxial cable 25, and the output terminal 31 is connected to the tuner 33 by the coaxial cable 32. In this state, the comparator 44*a* is operated from the DC voltage supplied from the tuner 33. Since it is rare for the antenna 26 to be correctly directed to the satellite from the beginning, usually the LED is energized to emit light, which indicates that necessary power is properly supplied to the measuring apparatus. The DC voltage from the tuner 33 is supplied to the converter 28 to energize the converter 28, too.

Then, the variable resistor 60 is adjusted to increase the sensitivity of the apparatus or to set the reference voltage to the comparator 40*a* lower so that the LED 50 emits light, and, then, the azimuth angle and the elevational angle of the antenna 26 are varied in a sense to increase the level of the received signal. This causes the LED 50 to stop emitting light. Thus, the antenna 26 has been directed generally toward the satellite. Then, the variable resistor 60 is adjusted again to decrease the sensitivity, that is, to increase the reference voltage applied to the comparator 40*a*, to thereby cause the LED 50 to emit light again. Then, fine adjustment is made to the azimuth and elevational angles of the antenna 26 until the LED 50 becomes not to emit light. This operation is repeated until the best receiving condition is attained.

When the operator temporarily puts the apparatus on, for example, a roof during the adjustment of the antenna direction, the flat surface 94*a* prevents the apparatus from rolling off the roof. Furthermore, because of the irregularities in the flat surface 94*a*, the measuring apparatus is prevented from slipping off the operator's hand when he keeps it by the hand. After the direction of the antenna is properly determined, the signal level measuring apparatus is decoupled, and the converter 28 is directly coupled through a coaxial cable to the tuner 33.

The present invention has been described by means of a system in which a satellite broadcast signal from a broadcast satellite is received by the receiving antenna, but the measuring apparatus of the present invention is equally useable in a system for satellite communications with other types of geostationary satellites, such as communications satellites.

In the described embodiment, the distributor 30 is used, but a directional coupler may be used instead. When a directional coupler is used, an output derived from the directional coupler is coupled to the level detector 40, and the directional coupler output is coupled to the output terminal 31. In the described embodiment, the level detector 40 and the comparator 44*a* form level measuring means. Alternatively, however, it may be so arranged that the output of the level detector is amplified. In such a case, the LED 50 can be used, but a meter may be used instead.

What is claimed is:

1. A signal level measuring apparatus for use in directing a receiving antenna to a geostationary satellite, said signal level measuring apparatus being adapted to be disposed between a converter associated with said receiving antenna to convert a satellite signal from said geostationary satellite as received by said receiving antenna into an intermediate frequency (IF) signal, and a tuner for demodulating said IF signal, said signal level measuring apparatus comprising:

an input terminal adapted to receive said IF signal;

level measuring means for measuring the level of said IF signal from said input terminal;

indicating means for indicating the measurement in said level measuring means;

an output terminal for coupling said IF signal to said tuner; and a housing for housing said input terminal, said level measuring means, said indicating means, and said output terminal;

wherein said housing includes a first section having a semi-circular cross-section and a second section coupled to said first section having a modified semi-circular cross-section having a flat surface extending along the length thereof, and a plurality of ridges or grooves formed in said flat surface of said second section to extend transversely across said flat surface are arranged along the length of said housing.

2. The signal level measuring apparatus according to claim 1 wherein said housing comprises first and second longitudinal halves, each having first and second longitudinal edges, said first longitudinal edges of first and second halves being hinged together; said housing further including a claw formed integrally with said first half of said housing, said claw protruding from the second edge of said first half of said housing and having elasticity; and a recess is formed in the inner surface of said second half of said housing at such a location slightly inward of said second edge of said second half that when said first and second halves are mated said claw engages with said recess.

3. The signal level measuring apparatus according to claim 1 wherein said level measuring means is disposed on a first major surface of a printed circuit board having a substantial portion of the second major surface placed at a reference potential; said printed circuit board is placed in a shield casing having an opening in one side thereof with said second major surface of said printed circuit board facing outward through said opening; said indicating means is disposed on said second major surface of said printed circuit board; said shield casing is housed within said housing; and an opening is formed in said housing such that said indicating means can be seen through said opening.

4. The signal level measuring apparatus according to claim 3 wherein projections are formed to protrude from the inner surface of said shield casing, said projections supporting said printed circuit board when said printed circuit board is placed in said shield casing.

* * * * *